United States Patent [19]

Barr et al.

[11] Patent Number: 4,733,735

[45] Date of Patent: Mar. 29, 1988

[54] ROTARY DRILL BITS

[75] Inventors: John D. Barr, Cheltenham; John M. Fuller, Penzance; Malcolm R. Taylor, Gloucester, all of England

[73] Assignee: NL Petroleum Products Limited, Gloucestershire, England

[21] Appl. No.: 913,101

[22] Filed: Sep. 29, 1986

[30] Foreign Application Priority Data

Oct. 1, 1986 [GB] United Kingdom ..... 8524146

[51] Int. Cl.[4] ..... E21B 10/60

[52] U.S. Cl. ..... 175/393; 175/417; 175/424

[58] Field of Search ..... 175/393, 412, 413, 414, 175/415, 416, 417, 418, 419, 424

[56] References Cited

U.S. PATENT DOCUMENTS

| | | | |
|---|---|---|---|
| 2,07,439 | 5/1950 | Goolsbee | 175/412 |
| 2,246,812 | 6/1941 | Pivoto | 175/412 |
| 2,498,251 | 2/1950 | Creel | 175/412 |
| 3,011,571 | 12/1961 | Bree et al. | 175/419 |
| 3,951,220 | 4/1976 | Phillips, Jr. et al. | 175/393 |
| 4,336,850 | 6/1982 | Fielder | 175/393 |
| 4,440,247 | 4/1984 | Saitor | 175/393 |
| 4,499,958 | 2/1985 | Radtke et al. | 175/413 |
| 4,527,642 | 7/1985 | Knowlton et al. | 175/393 |
| 4,577,706 | 3/1986 | Barr | 175/393 |
| 4,687,066 | 8/1987 | Evans | 175/393 |

*Primary Examiner*—Stephen J. Novosad
*Assistant Examiner*—William P. Neuder
*Attorney, Agent, or Firm*—Browning, Bushman, Zamecki & Anderson

[57] ABSTRACT

A rotary drill bit comprises a bit body having a leading face and a gauge region, a number of blades on the leading face of the bit body, and a number of cutting elements mounted along each blade. A passage in the bit body supplies drilling fluid to nozzles in the leading face of the bit body for cooling and cleaning the cutting elements. Each nozzle is so oriented, and the surface of the bit body in the region in front of each blade is so shaped, as to promote a vortex flow of drilling fluid around said region, with part of the periphery of the vortex extending across the cutting elements on the blade, so that fluid in the periphery of the vortex passes across the cutting elements mounted on each blade before escaping through an exit channel in the gauge region.

28 Claims, 8 Drawing Figures

ROTARY DRILL BITS

BACKGROUND OF THE INVENTION

The invention relates to rotary drill bits for use in drilling deep holes in subsurface formations.

In particular, the invention relates to drill bits of the kind comprising a bit body providing a leading face, a gauge region, and an annular space (known as the annulus) on the side of the gauge region remote from the leading face, a number of blades on the leading face, each blade having an outer surface which, in use, faces the surface of the formation being drilled and a front suface facing in the direction of normal forward rotation of the bit, a number of cutting elements mounted along each blade, a delivery passage in the bit body for supplying drilling fluid to a number of openings in the leading face of the bit, and at least one exit passage for returning said drilling fluid past the gauge region to the annulus. Said openings are so located on the forward side of a blade as to promote a flow of drilling fluid across the front surface of the blade and across the cutting elements mounted on the blade. The exit passage is usually in the form of an exit channel or junk slot formed in the outer surface of the gauge region, but the invention also includes arrangements where other forms of exit passage are employed.

A drill bit of this kind is described in U.S. Pat. No. 4,499,958. In the drill bit described in that specification, there are provided four blades and two openings for drilling fluid on the forward side of each blade, the openings being at different radial distances from the axis of rotation of the bit. There are provided four junk slots each of which extends, around the periphery of the bit, from the front surface of each blade to a location spaced a short distance from the rear of the next blade. Accordingly, almost the whole of the space between adjacent blades is in direct communication with the associated junk slot. Such an arrangement provides substantial clearance and a large flow path for the escape, through the junk slot, of cuttings produced by the cutting elements and it is believed that this is one of the reasons for the high penetration rates which drill bits of this kind may achieve in certain types of formation. However, a further important function of the drilling fluid is to cool the cutting elements and the formation on which the cutting elements are acting, and with the arrangement described in U.S. Pat. No. 4,499,958 such cooling may not be particularly effective in view of the fact that drilling fluid emerging from the nozzles in the bit body can flow directly to the junk slot without providing sufficient high velocity turbulent flow of fluid over the cutting elements and the formation to provide effective cooling.

The present invention provides an improvement to a drill bit of the kind first referred to, the improvement comprising the provision of a structure which controls the flow of drilling fluid emerging from the openings in the bit body in such manner as to promote a controlled vortex of flow on the forward side of each blade to give a greater velocity gradient to the flow over the cutting elements and thereby provide more effective cooling of the cutting elements and the formation on which they are acting.

It should be explained that in most conventional drill bits of the kind first referred to above, including the type described in U.S. Pat. No. 4,499,958, the flow of drilling fluid over the surface of the bit body and cutting elements is complex, and it may be assumed that such flow will also involve the generation of one or many small vortices, but in a generally uncontrolled manner. The present invention, however, depends on the production of a controlled vortex, that is to say the configuration of the bit body and the location of the openings therein for drilling fluid are such as inevitably to result in the generation of at least one major vortex in the region adjacent the front surface of the blade, the peripheral region of the vortex passing across several or all of the cutting elements mounted on the blade.

SUMMARY OF THE INVENTION

According to one aspect of the invention, in a rotary drill bit of the kind first referred to, at least one of the aforesaid openings is located in a region adjacent the front surface of a blade which region is bounded, when the bit is in use, partly by a surface portion of the bit body and partly by a surface portion of the formation being drilled, the opening being so orientated with respect to the said surface portions as to promote a vortex flow of drilling fluid around said region, with part of the periphery of the vortex extending across the cutting elements on the blade, at least part of said surface portion of the bit body which defines the aforesaid region being smoothly and concavely curved in a manner to facilitate the formation of said vortex, said exit passage being so located that fluid may escape from the periphery of the vortex into said exit passage and thence to said annulus.

At least a portion of the vortex flow over said surface portion of the formation may be in a direction outwardly away from the central axis of rotation of the drill bit, and in this case said exit passage may comprise an exit channel formed in the outer surface of the gauge region, which channel is located adjacent the front surface of the blade whereby fluid may escape directly into said exit channel from the periphery of the vortex after having passed outwardly across the cutting elements. Preferably, the part of said surface portion of the bit body which is adjacent said exit channel is inclined inwardly so as to face partly towards the longitudinal axis of rotation of the drill bit.

According to a second aspect of the invention, there is provided a rotary drill bit comprising a bit body providing a leading face, a gauge region, and an annulus on the side of the gauge region remote from the leading face, a number of blades on the leading face, each blade having an outer surface which, in use, faces the surface of the formation being drilled and a front surface facing in the direction of normal forward rotation of the bit, a number of cutting elements mounted along each blade, a delivery passage in the bit body for supplying drilling fluid to a number of openings in the leading face of the bit, and at least one exit channel formed in the outer surface of the gauge region for returning said drilling fluid past the gauge region to the annulus, at least one of the aforesaid openings being located in a region adjacent the front surface of a blade which region is bounded, when the bit is in use, partly by a surface portion of the bit body and partly by a surface portion of the formation being drilled, the opening being so orientated with respect to the said surface portions as to promote a vortex flow of drilling fluid around said region, with part of the periphery of the vortex extending across the cutting elements on the blade, at least a portion of the vortex flow over said surface portion of the formation being in a direction outwardly away from the central axis of rotation of the drill bit, whereby the fluid in the vortex reaches the outer periphery of the drill bit immediately after having passed outwardly across the cutting elements, there being provided an exit channel adjacent the front surface of the blade so that fluid may escape directly into said exit channel from the periphery of the vortex after having passed across the cutting elements, part of said surface portion of the bit body which is adjacent said exit channel being inclined inwardly so as to face partly towards the longitudinal axis of rotation of the drill bit.

The feature of part of the surface portion of the bit body, adjacent the exit channel, being inclined inwardly may be provided either in addition to or as an alternative to the smooth curvature of the surface portion of the bit body in the previously mentioned arrangements where fluid may escape directly into the exit channel from the periphery of the vortex. That is to say, if the surface of the bit body is inclined as specified adjacent the exit channel, it becomes less necessary for the surface portion to be smoothly curved and the vortex may be adequately generated by a more angular configuration of the surface.

Arrangements in accordance with both aspects of the invention provide two important main advantages. In order to provide efficient cooling and cleaning of the cutting elements in a drill bit it is desirable that the drilling fluid flows across the surfaces of the cutting elements at high velocity. This requires a high velocity gradient in the fluid adjacent the cutting elements, which in turn necessitates a very high velocity at a distance from the cutting elements and therefore a high volumetric flow rate. In conventional drill bits, the drilling fluid normally flows only once past each cutting element and thus the thermal capacity of the fluid is not used efficiently in cooling the elements. By recirculating a high proportion of the fluid in a controlled vortex however, in accordance with the invention, the recirculated portion of the fluid acts on the cutting elements more than once, and consequently performs its cooling function over a much longer total effective flow path than is the case with conventional bits. The cooling efficiency of the fluid may thus be considerably enhanced, permitting improved utilisation of the available flow rate of drilling fluid which, in any given drilling situation, is usually limited.

Furthermore, the centrifugal action of the vortex tends to cause cuttings entrained in the drilling fluid to migrate to the outer periphery of the vortex, from where they pass to the exit passage and thence to the annulus. Consequently, the recirculated portion of the fluid in the vortex is the inner, relatively clean fluid.

In the case where the exit passage comprises an exit channel along the gauge region of the bit, the exit channel may be shaped so as to increase in cross-section as it extends along the gauge region. A smoothly rounded edge region may be provided between the exit channel and said surface portion of the bit body.

Also in the arrangements referred to above in which fluid escapes directly into the exit channel from the periphery of the vortex, the cutting elements are preferably so disposed that said surface portion of the formation being drilled is smoothly and concavely curved immediately adjacent said exit channel, and said exit channel extends generally tangentially to said concavely curved surface portion of the formation.

As an alternative to the exit passage being an exit channel along the gauge region into which fluid passes directly from the periphery of the vortex, the exit passage may extend through the bit body from an opening in said surface portion of the bit body.

In this case at least a portion of the vortex flow over said surface portion of the formation is preferably in a direction inwardly towards the central axis of rotation of the drill bit, and said opening in said surface portion of the bit body is so located that fluid may escape through said opening and into the escape passage after having passed inwardly across the cutting elements. This inward flow of drilling fluid may provide better cooling and cleaning of cutting elements nearer the outer periphery of the bit. The opening through which drilling fluid is delivered is preferably so orientated with respect to said surface portions of the bit body and formation as to be directed towards the vicinity of the junction between said surface portions at the outer periphery of the bit. As a result the jet of drilling fluid from the opening will impinge with high velocity on the general area where the outermost cutting elements are located, these being the elements in respect of which adequate cooling and cleaning may be most critical.

In the last-mentioned arrangements the surface portion of the bit body is preferably smoothly and concavely curved immediately adjacent said opening into the exit passage, and said passage extends, at least initially, generally tangentially to said concavely curved portion of the bit body.

In any of the arrangements in accordance with the invention preferably substantially the whole of the surface portion of the bit body which bounds the aforesaid region in which the vortex is formed is smoothly and concavely curved. Similarly, the cutting elements are preferably so disposed that substantially the whole of the surface portion of the formation which bounds the aforesaid region in which the vortex is formed is also smoothly and concavely curved. Preferably also the surface portions of the bit body and the formation are of substantially equal and uniform curvature so that the region bounded thereby is substantially circular.

In any of the above arrangements a number of cutting elements may be mounted along the junction between said outer and front surfaces of each blade. The number of cutting elements are preferably arranged in a single row along each blade.

The region adjacent the front surface of the blade within which the vortex is promoted may be defined partly by a recessed portion of the leading face of the bit adjacent said surface. For example, said recessed portion may be bounded partly by a wall surface spaced forwardly away from said front surface of the blade and substantially parallel thereto.

DETAILED DESCRIPTION OF THE PREFERRED EMBODIMENTS

Figure 1:
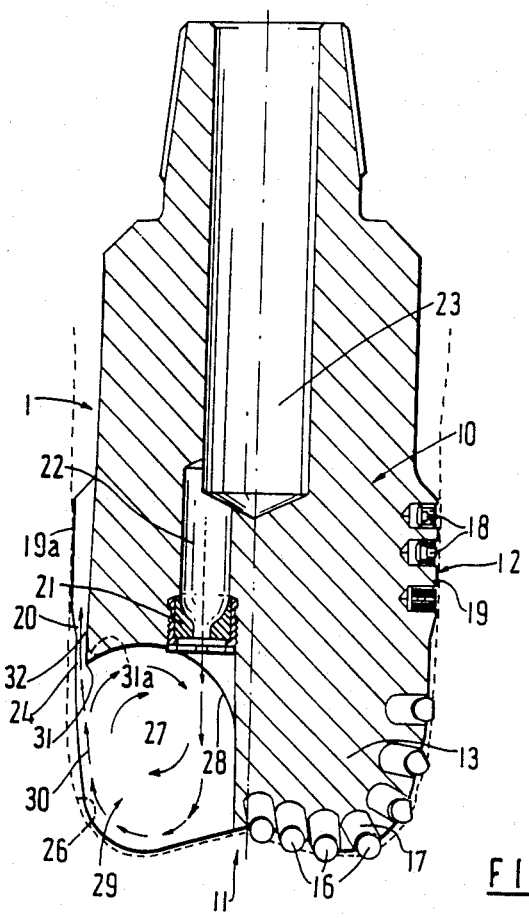
FIG. 1 is a vertical section through a drill bit, taken along the line I—I of FIG. 2, the cutting elements and posts being shown in elevation.
Figure 2:
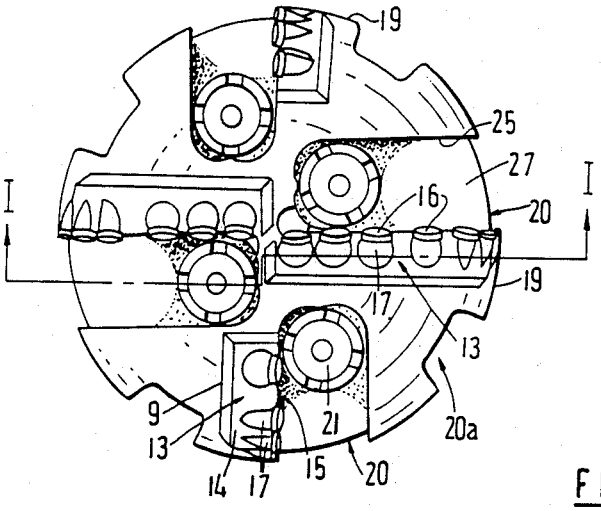
FIG. 2 is an end view of the bit shown in FIG. 1, and FIGS. 3 and 4, 5 and 6, and 7 and 8 are similar views to FIGS. 1 and 2 of alternative forms of drill bit according to the invention.

Referring to FIGS. 1 and 2, there is shown a rotary drill bit for use in drilling deep holes in subsurface formations comprising a bit body 10 having a leading face 11 and a gauge region 12.

The leading face of the bit body is integrally formed with blades 13. As best seen in FIG. 2 there are provided four such blades spaced substantially equally around the central axis of rotation of the bit. However, any other suitable number of blades may be employed, including only a single blade. Each blade has an outer surface 14 which, in use of the bit, faces the surface of the formation being drilled, and a front surface 15 facing in the direction of normal forward rotation of the bit. In the arrangements shown the front surface 15 of each blade lies in a substantially flat plane, but the invention includes within its scope arrangements where the front surface is concavely or convexly curved.

A number of cutting elements 16 are mounted on each blade along the junction between the outer face 14 and the front face 15. Each cutting element may be, as shown, in the form of a circular preform comprising a front hard facing layer of polycrystalline diamond or other superhard material bonded to a less hard backing layer, such as tungsten carbide. Each cutting element may be bonded to a post 17, for example of tungsten carbide, received in a socket in the blade 13. The junction between the outer surface 14 and the rear surface 9 of each blade may be chamfered as shown, for example at 45°, to a line just rearward of the post 17.

In known manner the gauge region 12 of the bit may be formed with wear or abrasion elements 18 which may, for example, comprise tungsten carbide studs impregnated with natural diamond particles and received in sockets in the gauge portion.

The cutting elements shown are only one example of the type of cutting elements which may be employed in a drill bit according to the invention, and it will be appreciated that the invention is applicable to drill bits incorporating any other form of suitable cutting element. For example, there may extend along each blade only a few large cutting elements, or even a single elongate cutting element providing only a single continuous cutting edge.

The gauge portion comprises four axially extending kickers or wear pads 19 in which the abrasion elements 18 are mounted, exit channels 20 being disposed between adjacent kickers 19. Each kicker may be formed with a slot 20*a*, the purpose of which is, in known manner, to allow drilling fluid to flow freely past the drill bit as it is introduced into the bore hole or withdrawn from the bore hole.

On the forward side of each blade 13 the bit body is formed with a recess 27. A nozzle 21 is mounted in a socket in the bit body at the bottom of each recess 27. Each nozzle communicates through a passage 22 with a central delivery passage 23. Drilling fluid supplied under pressure through the central passage 23 emerges from the nozzles 21 for the purpose of cleaning and cooling the cutting elements as well as cooling the formation.

In FIG. 1, the surface of the formation being drilled is indicated in dotted lines at 26. On the side of the gauge region remote from the leading face 11 of the bit, the bit body is of reduced diameter so as to provide an annular space 1, known as the annulus, between the bit body and the surrounding formation surface 26. The exit channel 20 provides communication between the leading face of the bit and the annulus.

A region 29 adjacent the front surface 15 of each blade is bounded partly by a portion of the surface 26 of the formation and partly by the smoothly and concavely curved bottom surface 28 of the recess 27. The wall 25 of the recess furthest from the front surface 15 of the associated blade is substantially flat and parallel to said front surface. (In the case, mentioned earlier, where the front surface of the blade is curved, the spaced wall bounding the recess may be similarly curved so as to be substantially parallel to the blade at all points along its length.) The associated exit channel 20 extends for the whole width of the recess 27, as shown in FIG. 2.

As best seen in FIG. 1, each nozzle 21 is so located in the region 29 and is so orientated (in this case substantially parallel to the central axis of rotation of the drill bit) that drilling fluid emerging under pressure from the nozzle impinges on the surface of the formation and is deflected in a curved path outwardly away from the axis of the bit into a vortex. The vortex will lie in a plane generally parallel to the front surface of the blade, the direction of flow being indicated generally by arrows 30. (The expression "generally parallel" is to be understood, in this context, to include arrangements where the vortex is curved to follow the general contour of a curved surface 15.)

As the fluid at the periphery of the vortex flows outwardly across the leading face of the blade and across the preformed cutting elements mounted thereon, it cools the cutting elements and the adjacent formation and also carries away from each cutting element the cuttings which it has removed from the formation. Such cuttings are swept around the region 29 by the vortex and, due to the centrifugal or cyclone effect thereof, are maintained in the outer peripheral region of the vortex.

As the vortex reaches the exit channel 20 it meets an edge region 31 where the curved concave surface 28 of the bit body meets the bottom wall 32 of the exit channel 20.

Adjacent the edge region, the surface portion 28 of the bit body may be inclined inwardly at about 45° so as to face partly towards the longitudinal axis of the bit, as shown. Other angles of inclination may be used, but in order to promote the vortex the angle is preferably always inclined inwardly. The edge region has the effect of dividing the flow in the vortex so that an outer portion, carrying a higher proportion of cuttings, exits through the exit channel 20 whereas the cleaner inner portion is re-circulated in the vortex around the curved concave portion 28 of the bit body.

In the arrangement shown the edge portion 31 is sharply angled but the edge may be rounded as indicated in dotted lines at 31*a*.

The exit channel 20 may increase in area, as shown, as it extends away from the region 29.

It is preferred to provide only one nozzle on the forward side of each blade since the single nozzle can be of comparatively large aperture diameter with less risk of blockage than if two or more nozzles were used, since such nozzles would have to be of smaller aperture. However, the invention includes within its scope arrangements in which more than one nozzle are used Also the number and configuration of the blades may be altered without departing from the scope of the invention, as may be the type and arrangement of the cutting elements on the blades.

Figure 3:
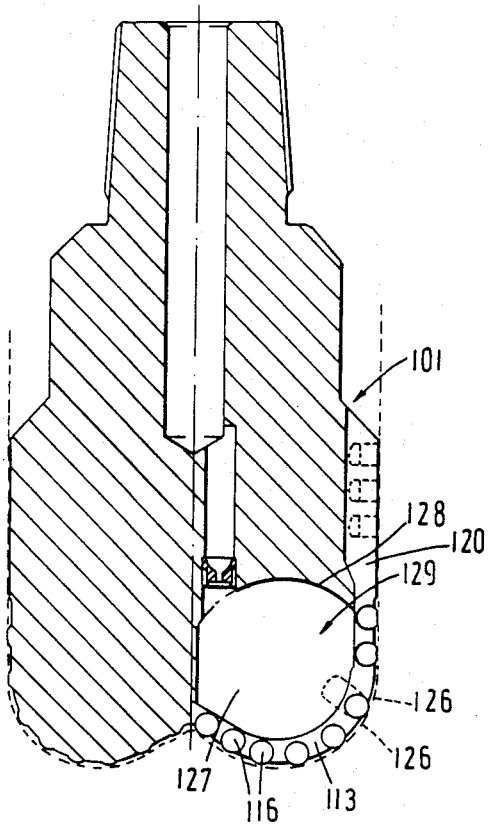
Figure 4:
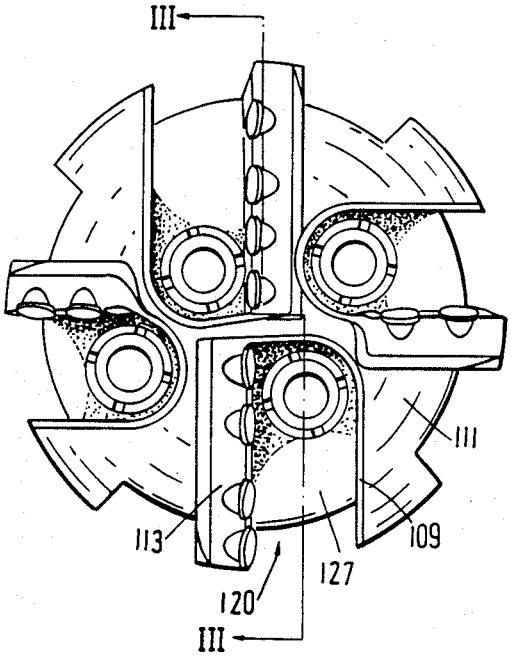

FIGS. 3 and 4 show a modified arrangement in which, in order to enhance the generation of a vortex in the region 129, the configuration of the blades 113 and the location of the cutting elements 116 is such that the surface 126 of the formation, cut by the cutting elements on the blade, forms a smooth continuation of the concave surface 128 of the recess 127. To enhance the generation of a vortex the concave surface 128 of the bit body and the surrounding surface 126 of the formation together approximate to a circle. The profile of the formation surface immediately adjacent the exit channel 120 is thus smoothly and concavely curved and the exit channel 120 extends tangentially thereto.

In order to minimise leakage of drilling fluid from the recess 127 across the leading face 111 of the bit body, an upstanding fence 109 is formed along the upper edge of the wall of the recess 127 opposite the blade 113, the fence extending also around the end of the recess containing the nozzle and joining the blade 113. The fence 109 engages the surface of the formation being drilled to minimise leakage of drilling fluid from or to the recess 127 and across the leading face of the bit, thereby assisting in maintaining the vortex and ensuring that most of the drilling fluid escaping from the recess 127 passes directly to the corresponding exit channel 120. In order to provide a more effective seal against the formation, the fence 109 could comprise a separate element of flexible material secured to the bit body.

As will be seen from FIG. 3 there will be small leakage paths for fluid between the blade 113 and the surface of the formation 126, between the cutting elements 116, but this leakage is small and the leakage space will become smaller as the cutters 116 become worn.

Figure 5:
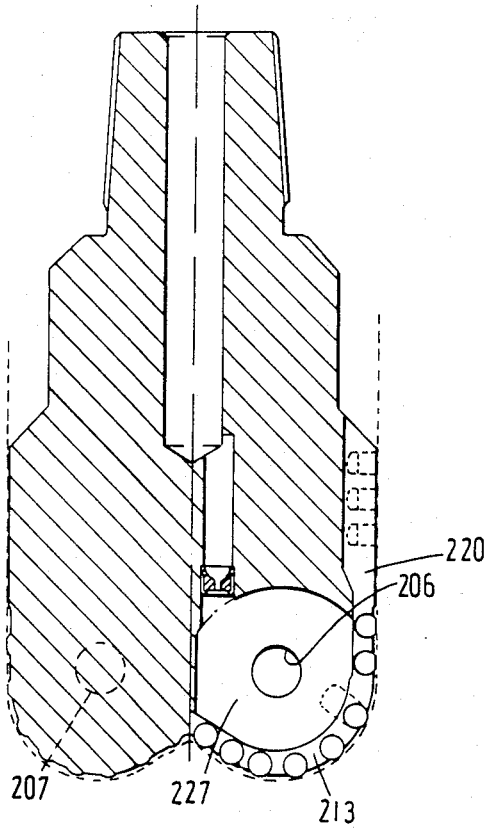
Figure 6:
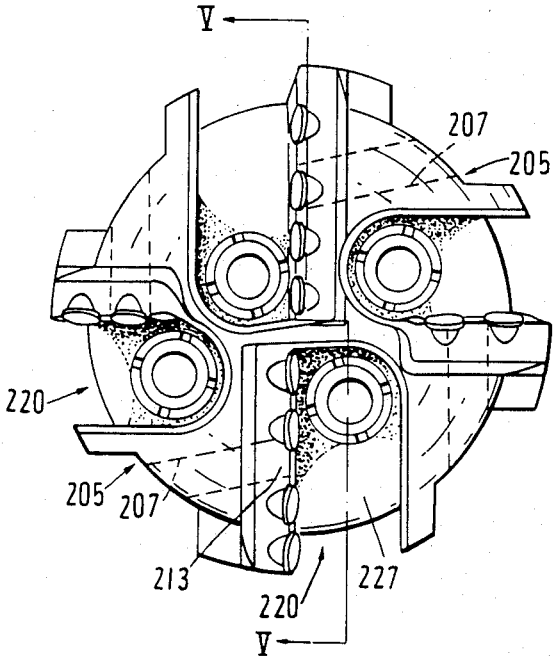

As previously explained, an object of the invention is to ensure that drilling fluid escapes to the exit channel 20 or 120 from the periphery of the vortex so that the proportion of fluid escaping to the exit channel carries with it the high proportion of cuttings which are entrained in the peripheral region of the vortex due to centrifugal force, the proportion of drilling fluid which is recirculated in the vortex entraining a much smaller proportion of cuttings. In order to enhance the vortex flow, it may be desirable to allow a proportion of the comparatively clean drilling fluid to escape from the central region of the vortex. Accordingly, there may optionally be provided for this purpose a circular exit passage leading from the central region of the vortex. Such passages are, for example, indicated at 207 in FIGS. 5 and 6, the drill bit shown in those figures being otherwise similar to that of FIGS. 3 and 4. As best seen in FIG. 6 each exit passage 207 extends from an outlet 206 in the wall of the recess 227 adjacent the blade 213 and extends through the main body of the bit to open into an exit channel 205 in the gauge region, the exit channels 205 being located around the gauge region alternately with the exit channels 220 with which the recesses 227 communicate directly.

Figure 7:
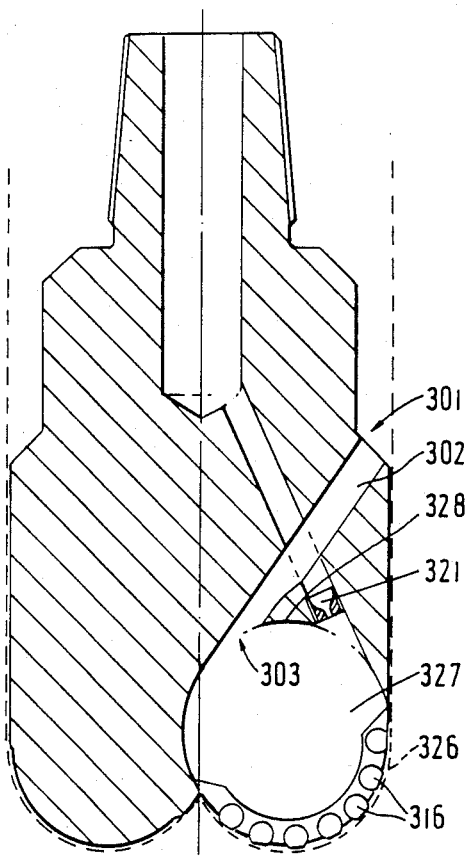
Figure 8:
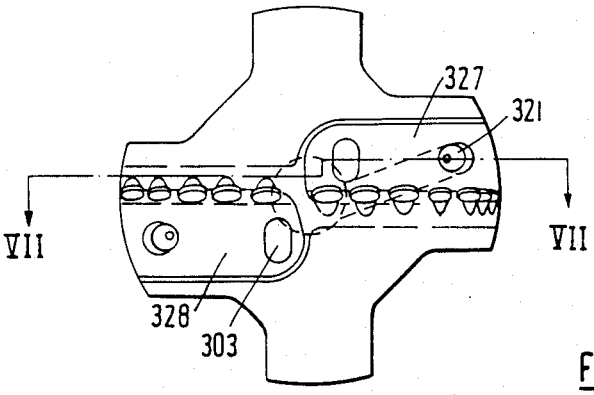

In the arrangements described above, the recess 27, 127 or 227 in front of each blade leads directly, at the periphery of the bit, into the associated exit channel 20, 120 or 220, and thence to the annulus. FIGS. 7 and 8 show a modified, two-bladed, arrangement where such exit channels are not provided, and communication between each recess 327 and the annulus 301 is by means of an opening 303 in the curved bottom wall 328 of the recess 327, which opening communicates with the annulus 301 through an exit passage 302 which extends through the bit body itself.

In this arrangement each nozzle 321 is so located that the vortex rotates clockwise as viewed in FIG. 7, so that the portion of the vortex flow which is over the formation and cutting elements is in a direction inwardly towards the central axis of rotation of the drill bit. The nozzle is also directed generally tangentially to the curved surface 328 of the bit body so as to impinge on the formation 326 in the vicinity of the junction between the bit body surface 328 and the formation. This ensures that the outermost cutting elements 316 of the bit are subjected to the high velocity jet of drilling fluid immediately after it emerges from the nozzle 321.

The exit opening 303 is so located in the surface portion 328 of the bit body that fluid at the periphery of the vortex may escape through the opening 303, into the passage 302, and thence into the annulus 301, after having passed inwardly across the cutting elements 316. To facilitate such escape the passage 302 extends tangentially from the surface portion 328 of the bit body. The nozzle 321 also extends tangentially to the surface portion to facilitate the generation of the vortex.

Fluid carrying the bulk of the cuttings thus escapes from the periphery of the vortex through the opening 303 leaving the relatively clean drilling fluid to be recirculated in the vortex.

We claim:

1. A rotary drill bit comprising a bit body providing a leading face, a gauge region, and an annulus on the side of the gauge region remote from the leading face, a number of blades on the leading face, each blade having an outer surface which, in use, faces the surface of the formation being drilled and a front surface facing in the direction of normal forward rotation of the bit, a number of cutting elements mounted along each blade, a delivery passage in the bit body for supplying drilling fluid to a number of openings in the leading face of the bit, and at least one exit passage for returning said drilling fluid past the gauge region to the annulus, at least one of the aforesaid openings being located in a region adjacent the front surface of a blade which region is bounded, when the bit is in use, partly by a surface portion of the bit body and partly by a surface portion of the formation being drilled, at least part of said surface portion of the bit body which defines the aforesaid region being smoothly and concavely curved and the cutting elements being so disposed that said surface portion of the formation being drilled is also concavely curved, whereby said region is enclosed by a continuous periphery without re-entrant portions, the opening being so oriented with respect to the said surface portions as to promote a vortex flow of drilling fluid around said region, with part of the periphery of the vortex extending across the cutting elements on the blade, said exit passage being so located that fluid may escape from the periphery of the vortex into said exit passage and thence to said annulus.

2. A rotary drill bit according to claim 1, wherein at least a portion of the vortex flow over said surface portion of the formation is in a direction outwardly away from the central axis of rotation of the drill bit, and wherein said exit passage comprises an exit channel formed in the outer surface of the gauge region, which channel is located adjacent the front surface of the blade whereby fluid may escape directly into said exit channel from the periphery of the vortex after having passed outwardly across the cutting elements.

3. A rotary drill bit according to claim 2, wherein the part of said surface portion of the bit body which is adjacent said exit channel is inclined inwardly so as to face partly towards the longitudinal axis of rotation of the drill bit.

4. A rotary drill bit according to claim 2, wherein the exit channel is shaped so as to increase in cross-section as it extends along the gauge region of the drill bit.

5. A rotary drill bit according to claim 2, wherein a smoothly rounded edge region is provided between the exit channel and said surface portion of the bit body.

6. A rotary drill bit according to claim 2, wherein the cutting elements are so disposed that said surface portion of the formation being drilled is smoothly and concavely curved immediately adjacent said exit channel, and said exit channel extends generally tangentially to said concavely curved surface portion of the formation.

7. A rotary drill bit according to claim 1, wherein said exit passage extends through the bit body from an opening in said surface portion of the bit body, whereby fluid may escape through said passage and into the annulus from the periphery of the vortex.

8. A rotary drill bit according to claim 7, wherein at least a portion of the vortex flow over said surface portion of the formation is in a direction inwardly towards the central axis of rotation of the drill bit, and wherein said opening in said surface portion of the bit body is so located that fluid may escape through said opening and into the exit passage after having passed inwardly across the cutting elements.

9. A rotary drill bit according to claim 8, wherein said opening through which drilling fluid is delivered is so orientated with respect to said surface portions of the bit body and formation as to be directed towards the vicinity of the junction between said surface portions at the outer periphery of the bit.

10. A rotary drill bit according to claim 7, wherein said surface portion of the bit body is smoothly and concavely curved immediately adjacent said opening into the exit passage, and said passage extends, at least initially, generally tangentially to said concavely curved portion of the bit body.

11. A rotary drill bit according to claim 1, wherein substantially the whole of the surface portion of the bit body which bounds the aforesaid region in which the vortex is formed is smoothly and concavely curved.

12. A rotary drill bit according to claim 1, wherein the cutting elements are so disposed that substantially the whole of the surface portion of the formation which bounds the aforesaid region in which the vortex is formed is smoothly and concavely curved.

13. A rotary drill bit according to claim 12, wherein said surface portions of the bit body and the formation are of substantially equal and uniform curvature so that the region bounded thereby is substantially circular.

14. A rotary drill bit according to claim 1, wherein a number of cutting elements are mounted along the junction between said outer and front surfaces of each blade.

15. A rotary drill bit according to claim 1, wherein said number of cutting elements are arranged in a single row along each blade.

16. A rotary drill bit according to claim 1, wherein the region adjacent the front surface of the blade within which the vortex is promoted is defined partly by a recessed portion of the leading face of the bit adjacent said surface.

17. A rotary drill bit according to claim 16, wherein said recessed portion is bounded partly by a wall surface spaced forwardly away from said front surface of the blade and substantially parallel thereto.

18. A rotary drill bit comprising a bit body providing a leading face, a gauge region, and an annulus on the side of the gauge region remote from the leading face, a number of blades on the leading face, each blade having an outer surface which, in use, faces the surface of the formation being drilled and a front surface facing in the direction of normal forward rotation of the bit, a number of cutting elements mounted along each blade, a delivery passage in the bit body for supplying drilling fluid to a number of openings in the leading face of the bit, and at least one exit channel formed in the outer surface of the gauge region for returning said drilling fluid past the gauge region to the annulus, at least one of the aforesaid openings being located in a region adjacent the front surface of a blade which region is bounded, when the bit is in use, partly by a surface portion of the bit body and partly by a surface portion of the formation being drilled, the opening being so orientated with respect to the said surface portions as to promote a vortex flow of drilling fluid around said region, with part of the periphery of the vortex extending across the cutting elements on the blade, at least a portion of the vortex flow over said surface portion of the formation being in a direction outwardly away from the central axis of rotation of the drill bit, whereby the fluid in the vortex reaches the outer periphery of the drill bit immediately after having passed outwardly across the cutting elements, there being provided an exit channel adjacent the front surface of the blade so that fluid may escape directly into said exit channel from the periphery of the vortex after having passed across the cutting elements, part of said surface portion of the bit body which is adjacent said exit channel being inclined inwardly so as to face partly towards the longitudinal axis of rotation of the drill bit.

19. A rotary drill bit according to claim 18, wherein the exit channel is shaped so as to increase in cross-section as it extends along the gauge region of the drill bit.

20. A rotary drill bit according to claim 18, wherein a smoothly rounded edge region is provided between the exit channel and said surface portion of the bit body.

21. A rotary drill bit according to claim 18, wherein the cutting elements are so disposed that said surface portion of the formation being drilled is smoothly and concavely curved immediately adjacent said exit channel, and said exit channel extends generally tangentially to said concavely curved surface portion of the formation.

22. A rotary drill bit according to claim 18, wherein substantially the whole of the surface portion of the bit body which bounds the aforesaid region in which the vortex is formed is smoothly and concavely curved.

23. A rotary drill bit according to claim 18, wherein the cutting elements are so disposed that substantially the whole of the surface portion of the formation which bounds the aforesaid region in which the vortex is formed is smoothly and concavely curved.

24. A rotary drill bit according to claim 23, wherein said surface portions of the bit body and the formation are of substantially equal and uniform curvature so that the region bounded thereby is substantially circular.

25. A rotary drill bit according to claim 18, wherein a number of cutting elements are mounted along the junction between said outer and front surfaces of each blade.

26. A rotary drill bit according to claim 18, wherein said number of cutting elements are arranged in a single row along each blade.

27. A rotary drill bit according to claim 18, wherein the region adjacent the front surface of the blade within which the vortex is promoted is defined partly by a recessed portion of the leading face of the bit adjacent said surface.

28. A rotary drill bit according to claim 27, wherein said recessed portion is bounded partly by a wall surface spaced forwardly away from said front surface of the blade and substantially parallel thereto.

* * * * *